United States Patent [19]

Jones

[11] Patent Number: 4,511,137

[45] Date of Patent: Apr. 16, 1985

[54] COMPOUND WEIGHT LIFTING EXERCISING MACHINE

[75] Inventor: Arthur A. Jones, Lake Helen, Fla.

[73] Assignee: Nautilus Sports/Medical Industries, Inc., Lake Helen, Fla.

[21] Appl. No.: 459,360

[22] Filed: Jan. 20, 1983

[51] Int. Cl.[3] ..... A63B 21/06

[52] U.S. Cl. ..... 272/118; 272/134; 272/144; 272/DIG. 4

[58] Field of Search ..... 272/118, 117, 130, 134, 272/143, 128; 128/25 R

[56] References Cited

U.S. PATENT DOCUMENTS

| | | | |
|---|---|---|---|
| 3,074,716 | 1/1963 | Mitchel et al. | 272/130 X |
| 3,640,527 | 2/1972 | Proctor | 272/118 |
| 3,734,495 | 5/1973 | Mist et al. | 272/118 |
| 3,834,694 | 9/1974 | Pridgen | 128/25 R |
| 3,851,638 | 12/1974 | Alexander | 124/24 R |
| 4,064,862 | 12/1977 | Groner | 124/23 R |
| 4,149,714 | 4/1979 | Lambert | 272/118 |
| 4,333,644 | 6/1982 | Lambert et al. | 272/118 |
| 4,349,193 | 9/1982 | Lambert et al. | 272/118 |

OTHER PUBLICATIONS

York Excalibre-Bow & Arrow Magazine, Jun. 1982, pp. 20, 21, 22.

*Primary Examiner*—Richard J. Apley
*Assistant Examiner*—William R. Browne
*Attorney, Agent, or Firm*—Bell, Seltzer, Park & Gibson

[57] ABSTRACT

The machine disclosed is for particular use in the duo-squat exercising of the legs and provides the proper variation of resistance to movement in all positions when the legs are being moved between the extended and retracted positions and vice versa. The machine includes a negative profile cam to which the force is applied by the user and the negative profile cam has a different length radius (moment arm) at different degrees of rotation. A weight stack is supported by a flexible member reeved over a wheel which has a radius of uniform length and being fixed to rotate with the negative profile cam. The length of the longest radius of the negative profile cam is less than the length of the uniform radius of the wheel so that the amount of force applied by the user is greater than the amount of weight provided by the weight stack.

9 Claims, 10 Drawing Figures

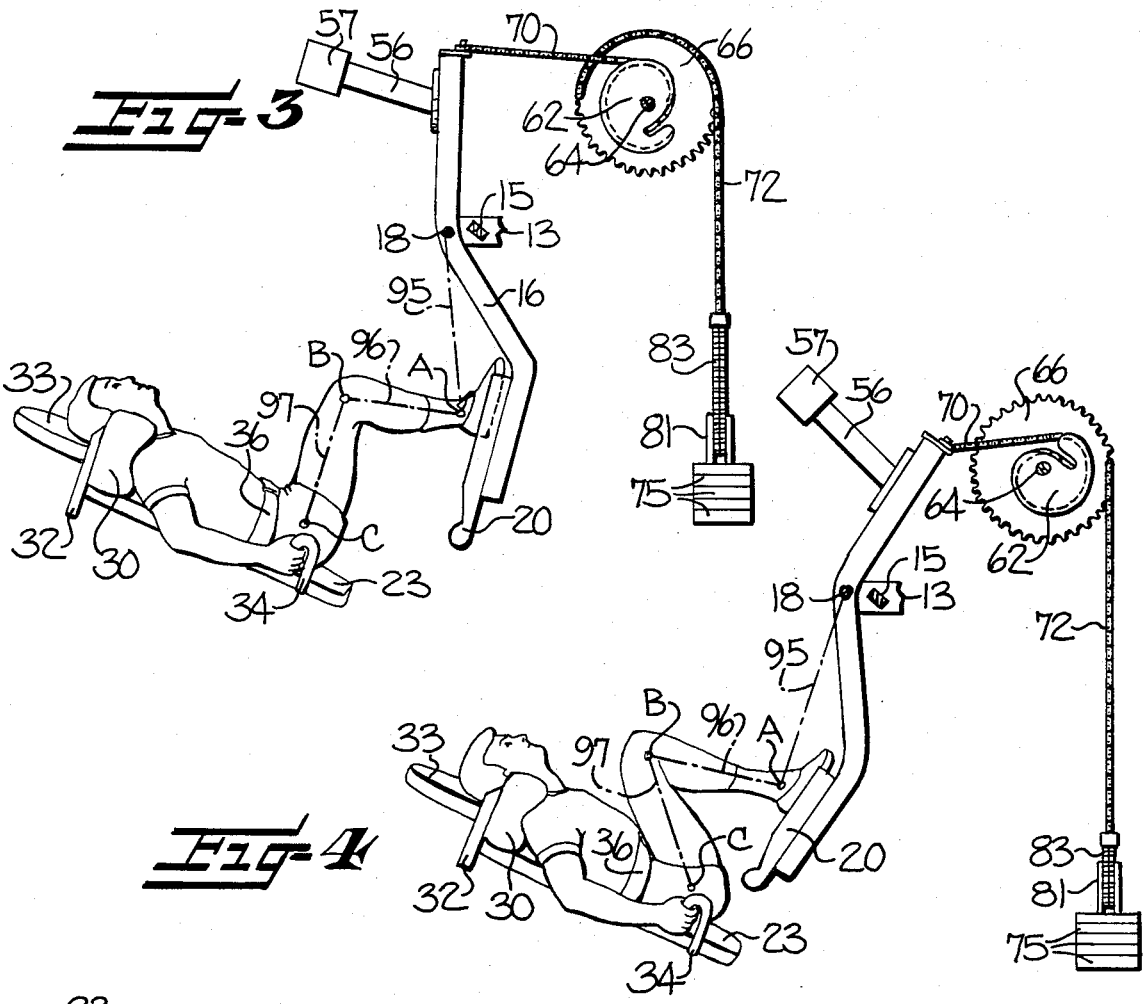
Fig-3
Fig-4
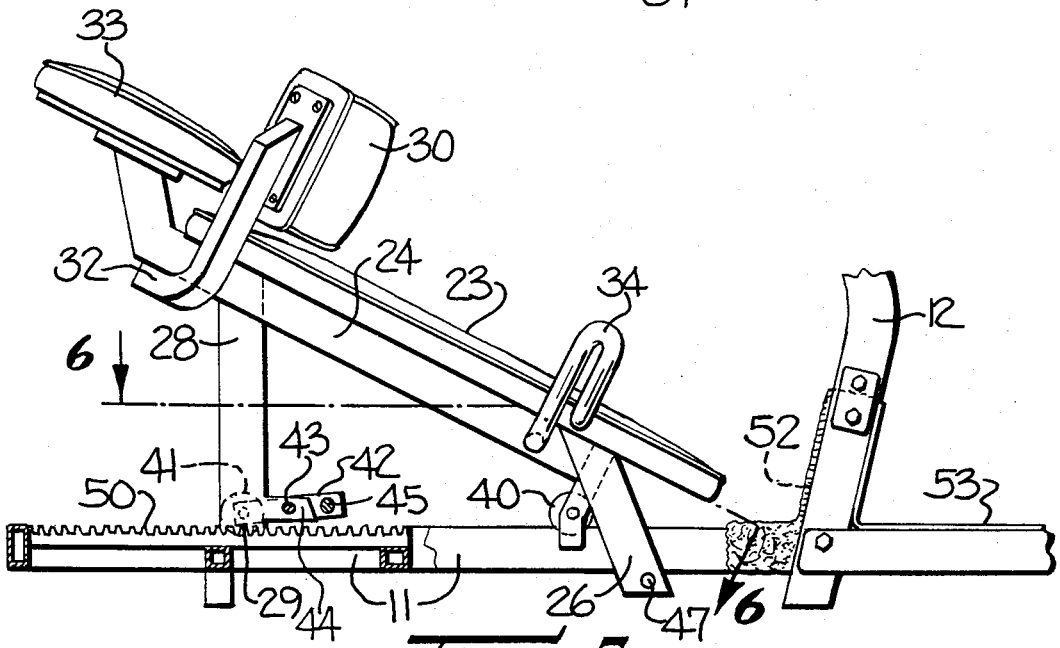
Fig-5

COMPOUND WEIGHT LIFTING EXERCISING MACHINE

FIELD OF THE INVENTION

This invention relates generally to a machine for the compound exercising of the muscles associated with the limbs and more particularly to such a machine which provides the proper variation of resistance to movement in all pivotal positions of the body parts around two or more body joints when the distal end of the limb is being moved between the extended and retracted positions and vice versa, such as a barbell squat exercise.

BACKGROUND OF THE INVENTION

Many different types of exercising machines have been developed for use in the field of body building. These machines provide a linear resistance or force against which the user works when repeating a series of single-axis exercises with pivotal movement of a single body member about a single body joint. However, this type of machine provides a uniform amount of resistance or force throughout the exercise movement but does not provide the proper type of variable resistance throughout the entire range of possible movement of the body member.

A significant improvement was achieved in this type of single-axis exercise machine with the invention by the present applicant of the variable resistance exercising machine disclosed in U.S. Pat. No. 3,858,873. The machine of this patent employs spiral pulleys with a different length radius (moment arm) at different angular positions therearound and a weight is attached by a flexible connector to a particular location on the outer surface of the spiral pulley so that the resistance to rotation of the spiral pulley varies, depending upon the length of the moment arm formed by the varying radius of the spiral pulley at various rotational positions. The configuration of the spiral pulley is designed so that the proper amount of muscular resistance is provided throughout the full range of pivotal movement of the body part during the single-axis exercise.

The spiral pulley disclosed in my prior patent will be referred to as a positive profile cam in which the weight is connected to a particular location on the positive profile cam by a flexible connector and the positive profile cam provides moment arms of varying lengths as the positive profile cam is rotated and the flexible connector is wound onto and unwound from the positive profile cam. The force applied by the user is applied to a force applying lever having a moment arm which is longer than any moment arm of the positive profile cam so that the user applied force is multiplied by the force applying lever and the positive profile cam. The rotational axis of the positive profile cam is positioned on a common axis with the involved joint of the body. As is known, the available strength of the muscles of the involved body parts varies at different positions of movement during an exercise and the positive profile cam of my prior machine provides a correspondingly varied resistance to provide a balanced resistance over the full range of the single-axis type of exercise.

However, a compound exercise, that is, an exercise involving two or more body parts and two or more body joints, requires a greater amount of resistance, and a wider range of variation in resistance than it is possible to obtain with the positive profile cam used in my prior machine. Also, the variation in resistance required in a compound exercise machine varies so rapidly and to such a large extent, particularly at certain times during the exercise, that a great amount of angular movement must be imparted to the profile cam by a very small amount of movement of the force applying lever, and it is not possible to accomplish this with the positive profile cam used in my prior machine.

Everything else being equal, a compound exercise, such as a barbell squat, is always a much more productive exercise than any single-axis exercise, such as a barbell curl. The compound exercise is more productive because it involves a far greater mass of muscle than the single-axis exercise. For example, a barbell squat exercise involves the largest and most powerful muscles of the body, the buttocks, the large muscle of the frontal thigh, the lower legs, the muscles of the lower back and others. While the barbell squat is a very productive exercise, it can be dangerous and can cause damage to the knee if not properly performed. Because of the manner in which the calf muscle engages the back of the thigh when the leg is bent to its limit at the lowest end of the squat, the normal pivot point at the knee joint is actually moved rearwardly several inches, to the point where the calf muscle engages the back of the thigh. Since the vertical direction of the weight tends to force the buttocks toward the heels, in a direction transversely of the bones in the upper and lower leg, forces are applied in the knee joint which tend to pull the knee joint apart.

Because of the problems pointed out above, it has not been possible to provide a satisfactory machine for the proper type of variable resistance compound exercising of the muscles associated with the limbs, and to permit the productive type of exercise, such as provided by the squat, while eliminating the potential danger of damaging the knee.

BRIEF DESCRIPTION OF THE INVENTION

With the foregoing in mind, it is an object of the present invention to provide a machine for the proper compound exercising of the muscles associated with the limbs which provides the proper variation of resistance to movement in all pivotal positions of two or more body joints when the distal end of the limb is moved in a substantially straight line between the extended and retracted positions and vice versa. The present machine also eliminates the potential danger of damaging the knee when performing a squat-type exercise.

The compound exercising machine of the present invention applies a properly varied resistance to the lower leg in a direction longitudinally of the bones in the leg, rather than in a transverse direction, so that the potential danger of damaging the knee is eliminated. Also, the present compounding exercising machine utilizes a spiral pulley or negative profile cam which operates differently than the operation of the positive profile cam of the type heretofore used in single-axis exercise machines.

For example, when using a positive profile cam with a variable radius, the positive profile cam is connected to the weight and the force applied by the user is applied by a rotary member with a uniform radius (moment arm) throughout the full length of the rotary motion. The moment arm of the force applying rotary member is always longer than any radius (moment arm) of the positive profile cam. Thus, the force applied by the user is increased by a factor which is the result of the difference between the length of the radius (moment arm) of the rotary force applying member and the length of the radius (moment arm) of the positive profile cam at any particular degree of rotation thereof. Therefore, the amount of force applied by the user is less than the amount of weight lifted.

On the other hand, when using a negative profile cam with a variable radius, the force applied by the user is applied to the negative profile cam and the radius (moment arm) of the negative profile cam is always shorter than the radius (moment arm) of the uniform radius rotary member connected to the weight. Thus, the force applied by the user is decreased by a factor which is the result of the difference between the length of the radius (moment arm) of the negative profile cam at any particular degree of rotation thereof and the length of the radius (moment arm) of the uniform radius rotary member. Therefore, the amount of force applied by the user is greater than the amount of weight lifted.

For the first time, the negative profile cam provides the proper amount of variable resistance to movement of the muscles associated with the body parts when a compound exercise is being performed so that the proper amount of resistance is provided in all pivotal positions of the body parts when moving about two or more body joints. By using a negative profile cam, there is literally no limit to the force the user can produce except the limits imposed by the user's body and the limits imposed by the strength of the material of which the machine is constructed. While it is true that a person has very high strength when the legs are straight, or almost straight, near the fully extended position near the top of a squat, the bones will not support an infinite weight. Therefore, the negative profile cam of the present machine has been designed with this limitation in mind. By using a variable weight stack of up to 510 pounds, a maximum force of approximately 1,174 pounds is required to be produced by the user when the legs approach and reach the finishing or lock-out position of the squat and this is sufficient force to tax the strength of even the strongest of men.

The use of the compound exercising machine is not, however, limited to use only by strong men, but is of equal benefit when used by weak men and women. For example, by using a minimum weight of 35 pounds, a total work load or force of approximately 80 pounds is required to be produced by the user as the legs approach and reach a "lock-out" or substantially straight position and this load or force is so low, equal to the force imposed on the body by gravity when an 80-pound person is standing still, that almost literally any person can use this machine properly.

The present compound exercising machine also includes other advantages over known types of exercising machines. A selectively operable stop rod is provided to limit the upward movement of the weight stack and to permit the performance of infimetric or akinetic exercises. When using the machine for infimetric exercise, the stop rod prevents the weight from "floating" upwardly during the last portion of a movement performed at high speed. When using the machine for akinetic exercises, the stop rod provides a predetermined weight to be used to supplement any resistance applied by the user with one limb resisting movement of the other limb. With this feature, the machine is the best possible source of cardiovascular benefit and the same type of benefits can be provided as are provided by any amount of running or jogging, without the pounding that is unavoidably involved in such activity, as well as the benefit provided by either stationary or moving bicycle riding.

The use of counterweights on the user actuated force applying levers maintains the force applying levers in the midrange of possible movement so that the user can safely get into and out of the machine. The machine is provided with a body support platform which maintains the axis of the spine in a straight position and at a slight incline of approximately 30 degrees from the horizontal. The body support platform is adjustable longitudinally along the machine frame and in a direction toward and away from the force applying levers so that the machine may be easily adjusted to accommodate users of different sizes. The adjustable body support platform also permits adjustment of the maximum stroke of movement of the force applying levers so that the user may, if desired, avoid the "lock out" position which normally occurs at the end of the fully extended position of the legs.

The compound exercising machine of the present invention includes a frame supporting the components of the machine. A pair of user actuated levers is pivotally supported in a substantially vertical position and in adjacent relationship on the frame for swinging back and forth movement of the lower ends thereof. Elongated foot pedals are supported on the lower ends of the levers at a predetermined distance below the pivotal connection of the levers and are adapted to be engaged by the foot of the user so that the levers may be moved back and forth through a predetermined arc of movement by the substantially straight line movement of the feet between the extended and retracted positions and vice versa. A negative profile cam is supported for rotation on the frame and fixed to rotate with a wheel having a uniform radius. The negative profile cam has a different radius at different degrees of rotation thereof to provide moment arms of different lengths as the negative profile cam is rotated.

A first flexible connector is fixed at one end to a position on the negative profile cam and is connected at its other end to the force applying lever at a position spaced from the pivotal support thereof. A second flexible connector is fixed at one end to a position on the wheel and is connected at its other end to a stack of weights. The second flexible connector is wound onto the wheel to lift the selected number of weights while the first flexible connector is being unwound from the negative profile cam when the force applying lever is being moved toward one end of the arc of movement. The second flexible connector is unwound from the wheel to lower the weight when the first flexible connector is being wound onto the negative profile cam when the lever arm is being moved toward the other end of the arc of movement so that the proper variation of resistance to movement is provided in all positions when the limb is being moved between the extended and retracted positions and vice versa.

BRIEF DESCRIPTION OF THE DRAWINGS

Some of the objects of the invention having been stated, other objects and advantages will appear as the description proceeds when taken in connection with the accompanying drawings, in which:

FIGS. 2–4 are somewhat schematic side elevational views of the exercising machine of FIG. 1, showing the range of movement of one leg of the user and the range of movement of the corresponding actuating lever when moving the leg between the fully extended and the retracted positions and vice versa;

FIG. 5 is a fragmentary elevational view of the body supporting platform, with parts of the frame broken away for purposes of clarity;

DESCRIPTION OF THE ILLUSTRATED EMBODIMENT

The machine of the present invention is illustrated as being particularly adapted for the compound exercising of the muscles associated with the legs, the buttocks, and the lower back in what is commonly known as a squat exercise. However, it is to be understood that the present invention may also be incorporated in a compound exercising machine for exercising the arms, in a manner similar to the well-known barbell bench press.

The illustrated machine includes a frame having a lower horizontal base frame (best illustrated in FIG. 7) and a pair of upstanding side frames 12, 13 which are connected to the base frame 11 at their lower ends. The upper portions of the side frames 12, 13 are maintained in spaced-apart relationship by suitable crossframes 14 and 15.

Figure 2:
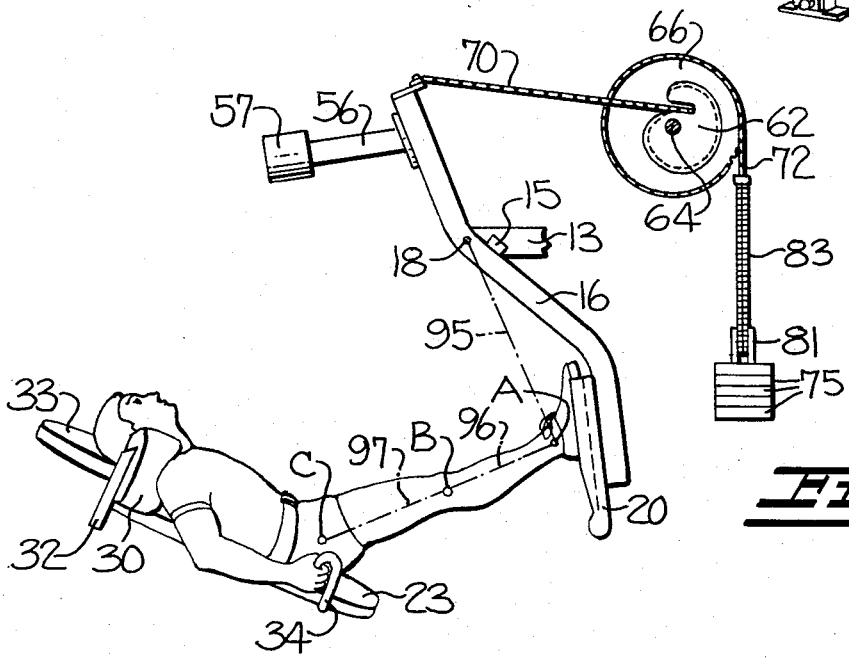
Figure 6:
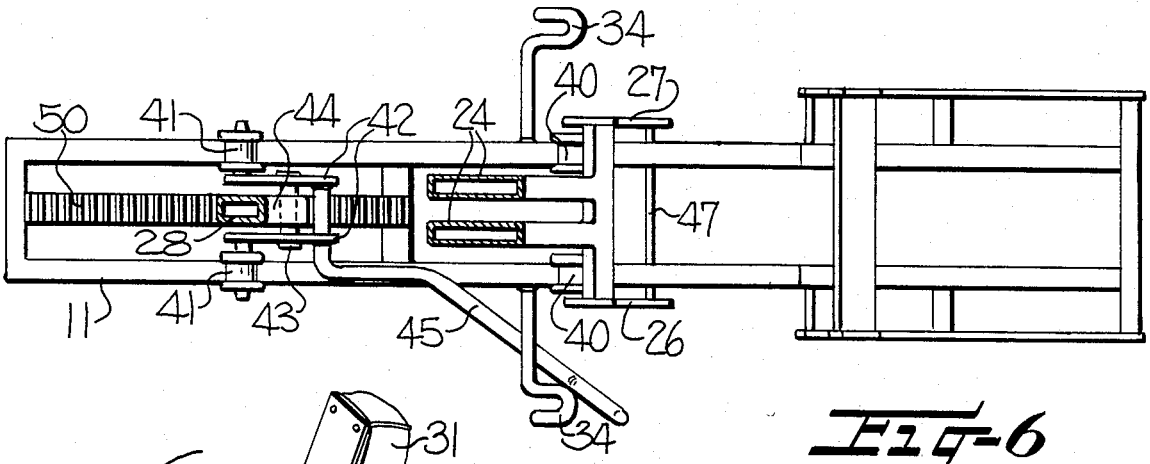
FIG. 6 is a horizontal sectional view taken substantially along the line 6—6 in FIG. 5.

A pair of user actuated levers 16, 17 is pivotally supported on a pivot shaft 18 extending between and fixed at opposite ends on the side frames 12, 13. The levers 16, 17 are pivotally supported in spaced-apart relationship and substantially vertical positions for swinging back and forth movement of the lower ends thereof. Force transfer means, in the form of elongate foot pedals 20, 21 are fixed on the lower ends of the respective levers 16, 17 and are adapted to be engaged by the respective right and left feet of the user so that the lower ends of the levers 16, 17 may be moved back and forth in a predetermined arc of movement during the exercise. The forward end of the arc of movement of the lever 16 is illustrated in FIG. 2 with the leg of the user in substantially extended position and with the lever 16 in engagement with the crossbar 15, which provides a stop for the forward movement of the lever 16. The rearward end of the arc of movement of the lever 16 is reached when the leg is in substantially retracted (squat) position, as shown in FIG. 4.

Body support means, illustrated as a body support platform, is supported for longitudinal adjustment along the lower frame 11 and includes a body support pad 23 for supporting the upper torso of the user in a reclining position with the spine in a substantially straight condition, as illustrated in FIGS. 1–4. The body support pad 23 is fixed on an inclined frame 24 having downwardly extending forward legs 26, 27 and a single downwardly extending rear support leg 28, the lower end of which is provided with rack teeth, indicated at 29 in FIG. 7.

Figure 1:
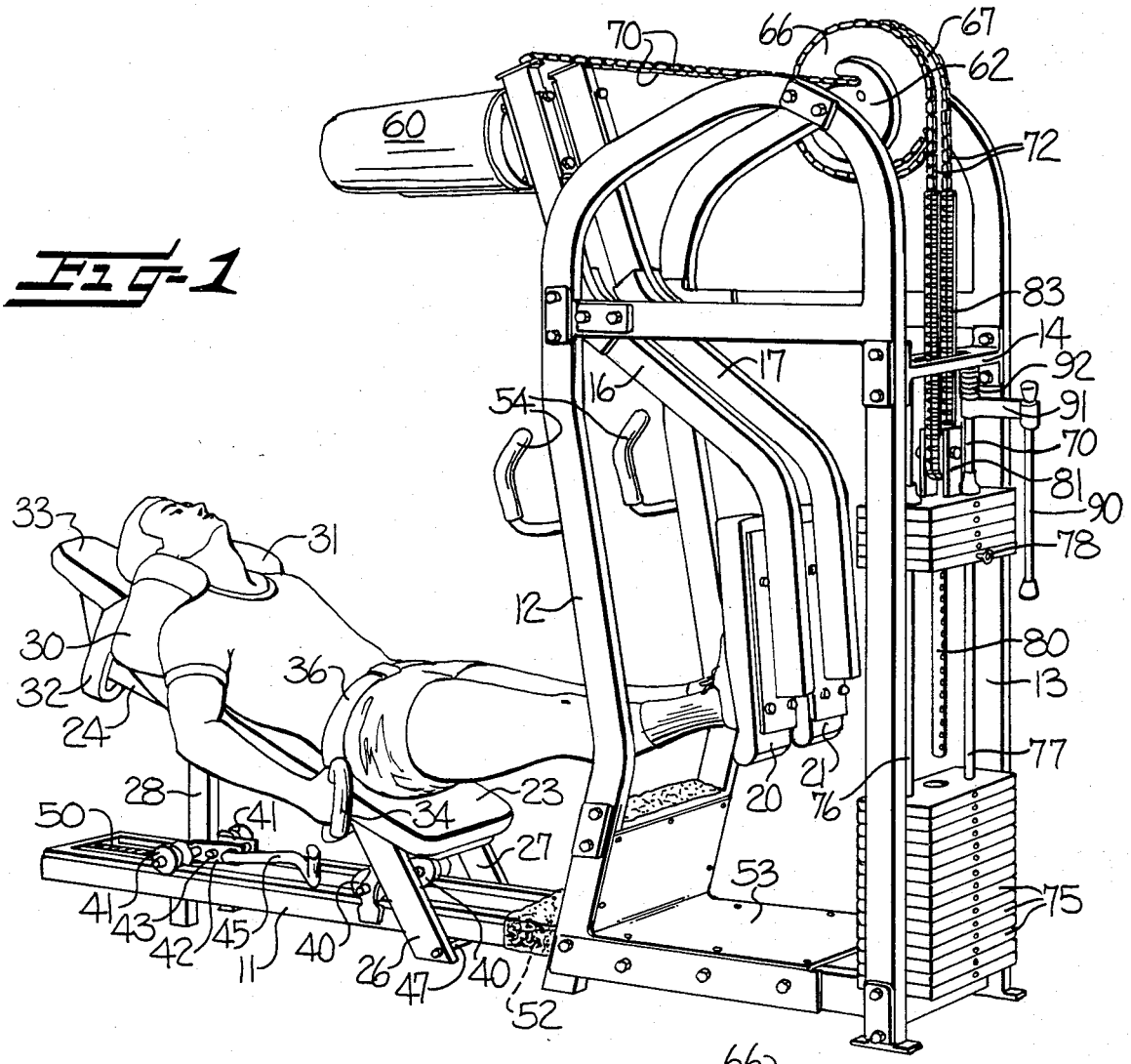
FIG. 1 is a perspective view of the compound exercising machine of the present invention, illustrating the user in position to begin a squat-type of exercise.

Shoulder engaging cushions or pads 30, 31 are supported on the opposite upper ends of a substantially U-shaped support bracket 32 fixed at its medial portion on the inclined frame 24. An elevated headrest pad 33 is fixed on the frame 24 and between the shoulder pads 30, 31. When the machine is used, the upper torso of the user is positioned on the body support pad 23 in the manner illustrated in FIG. 1 with the shoulders in engagement with the pads 30, 31 and the head resting on the headrest pad 33. The hands may grip the opposite end portions of handgrip rods 34, the medial portion of which extends beneath the body support pad 23 and is fixed to the frame 24 with opposite ends being curved as illustrated in FIGS. 1 and 5. To stabilize the body on the pad 23 and to maintain the spine in a substantially straight condition during the exercise, a body engaging belt 36 is connected at each end to the body support pad 23 and is adjustably buckled into position across the lower body of the wearer, as illustrated in FIG. 1. The body support pad 23 and frame 24 are supported on the base frame 11 at an inclined angle of 30 degrees, relative to the horizontal. However, this particular angle may be varied, if desired.

Figure 7:
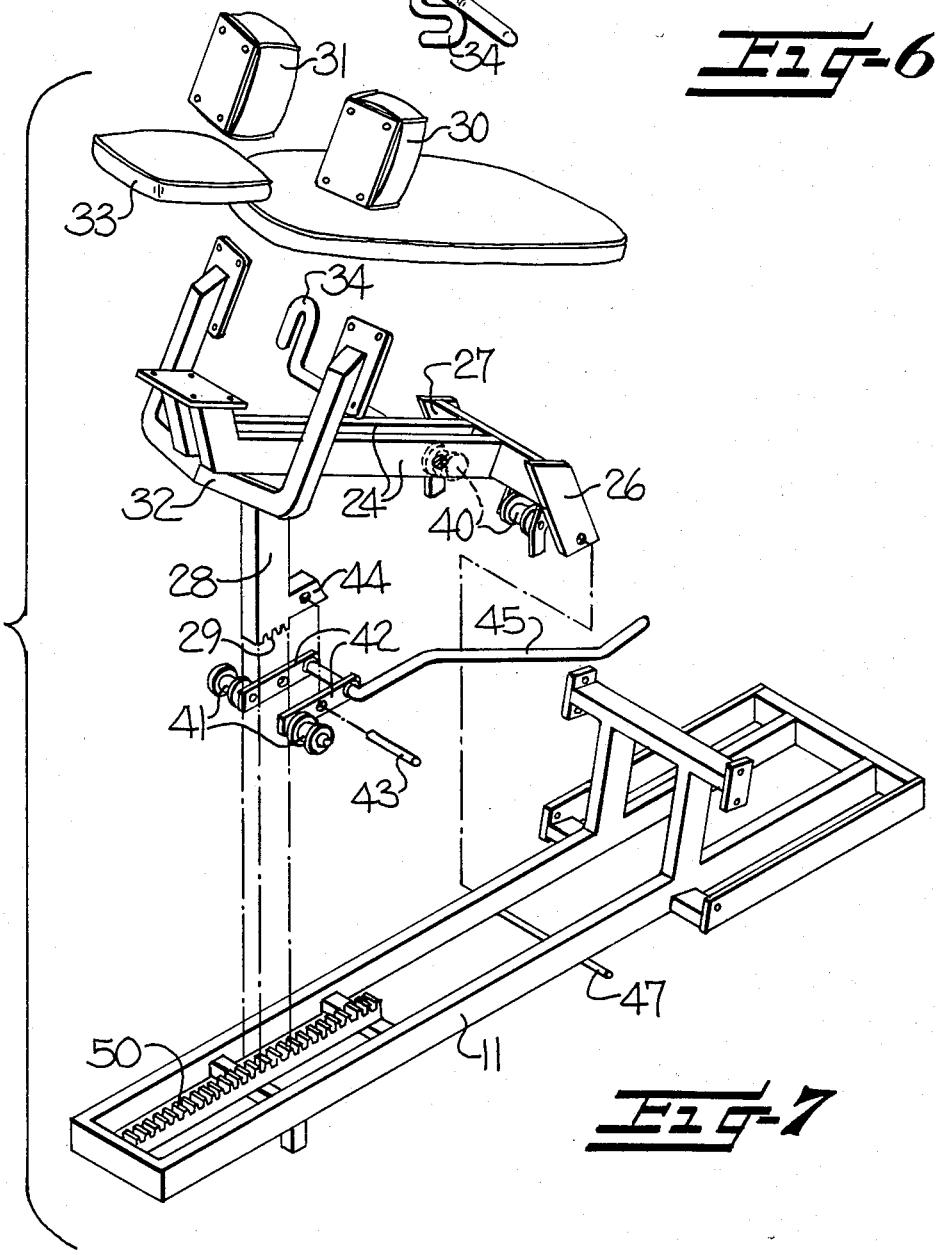
FIG. 7 is an exploded isometric view showing the base frame and the manner in which the adjustable body support is supported for longitudinal adjustment therealong.

The body support platform is supported for longitudinal adjustment along the lower frame 11 and is provided with a pair of front guide rollers 40 which are supported to ride along the upper surfaces of the side rails of the base frame 11, and a pair of rear guide rollers 41 which also ride along the upper surfaces of the side rails of the base frame 11. As best shown in FIG. 7, the rear guide rollers 41 are rotatably supported on the rear ends of lever arms 42, pivotally supported intermediate their ends on a pivot pin 43. The pivot pin 43 is fixed intermediate its ends on a support and guide plate 44, fixed to the lower end portion of the rear support leg 28. A control handle 45 is fixed at its inner end to the forward ends of the lever arms 42 and its other end extends outwardly to a convenient location for operation by the user. A stabilizer rod 47 extends beneath the trackways of the base frame 11 and its opposed ends are fixed in the lower ends of the forward legs 26, 27 to prevent upward movement of the front end of the body support platform and to maintain the front guide rollers 40 in engagement with the upper surfaces of the base frame 11.

The rack teeth 29 on the lower end of the leg 28 engage a rack 50 fixed in position between the side rails of the base frame 11 and maintain the body support in the longitudinally adjusted position along the frame 11. In order to move the body support from one longitudinally adjusted position to another, along the rack 50, the outer end of the control handle 45 is raised so that the rack teeth 29 on the lower end of the rear leg 28 are lifted above and out of engagement with the rack 50 while the guide rollers 41 remain in engagement with the upper surfaces of the side rails of the base frame 11. The body support may then be moved forwardly or rearwardly the desired distance and the outer end of the control handle 45 is lowered so that the rack teeth 29 on the lower end of the rear leg 28 are again in engagement with the rack 50 at the newly adjusted position. The body support is longitudinally adjustable so that the machine can accommodate users of various sizes.

As shown in FIGS. 1 and 5, the machine is preferably provided with a first cover plate 52 which extends between the rails of the lower frame 11 and up between the lower portions of the side frames 12, 13. This first cover plate 52 may be provided with a carpetlike covering. A second cover plate 53 extends vertically between the lower portions of the side frames 12, 13 and horizontally between the lower portions of the side frames 12, 13. Covered handles 54 are fixed at their forward ends on the corresponding side frames 12, 13 (FIG. 1) and extend rearwardly and forwardly. The handles 54 aid the user in positioning himself on the body support platform when entering the machine to exercise, and to aid the user in lifting the body from the body support platform when the exercise is completed.

The upper end portions of each of the levers 16, 17 are provided with counterweight arms 56 (FIGS. 2–4) fixed at their inner ends on the levers 16, 17 and inclined upwardly therefrom with their free ends supporting counterweights 57. As shown in FIG. 1, the arms 56 and counterweights 57 are covered by padded circular coverings 60 to protect the user from direct contact with the counterweights 57 and the arms 56. The function of the counterweights 57 will be presently described.

Figure 8:
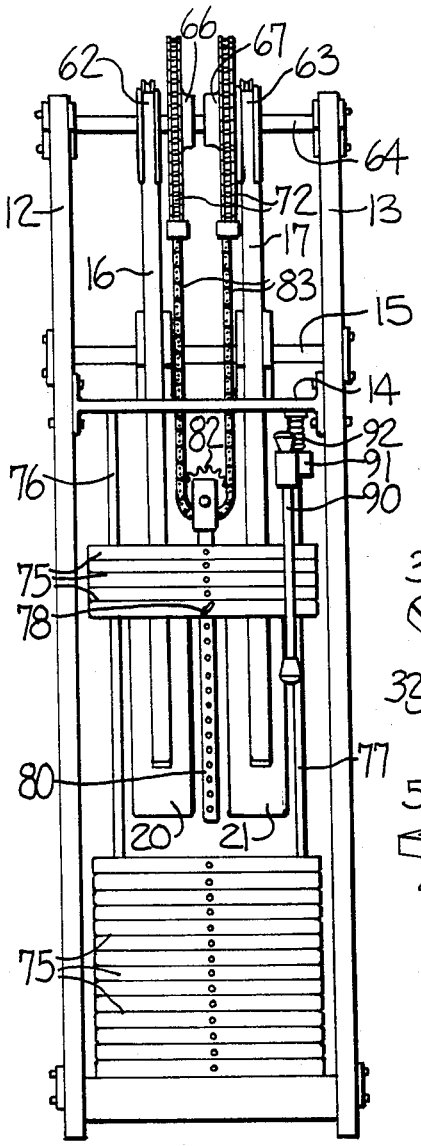
FIG. 8 is an end elevational view of the machine, looking at the right-hand end of FIG. 1.

A pair of negative profile cams, indicated at 62, 63 in FIG. 8, is supported for rotation on a shaft 64, supported at opposite ends on the inner portions of the side frames 12, 13. The negative profile cams 62, 63 are identical and operate in the same manner. Each negative profile cam is provided with a different radius at different degrees of rotation thereof to provide moment arms of varying lengths as these negative profile cams are rotated about the support shaft 64. The negative profile cams 62, 63 are positioned in adjacent spaced relationship on the support shaft 64 and are fixed to corresponding outer sides of respective sprocket wheels 66, 67 which are also supported for rotation on the shaft 64. The sprocket wheels 66, 67 are also identical to each other and each has a uniform radius to provide the same length of moment arms throughout all degrees of rotation.

A pair of first flexible connector means, illustrated as sprocket chains 70, is fixed at one end to a particular angular position on the corresponding negative profile cams 62, 63 while the other ends of the chains 70 are connected to the upper ends of the corresponding levers 16, 17. A pair of second flexible connector means, illustrated as sprocket chains 72, is fixed connected at one end to a particular angular position on the corresponding sprocket wheels 66, 67 while the other ends of the chains 72 are connected to weight means, in a manner to be presently described.

The weight means is supported for vertical movement on the machine frame and is illustrated as including a stack of individual weight plates 75 which are guided for vertical movement on a pair of weight guide rods 76, 77 (FIG. 8), the lower ends of which are fixed on the base frame 11 and the upper ends of which are fixed on the crossframe 14. Each of the weight plates 75 is provided with a central horizontal bore adapted to receive a weight support pin 78 which extends inwardly thereof and is adapted to engage horizontal bores in a vertical weight selector rod 80. The weight selector rod 80 extends through vertical openings extending through the central portions of each of the weight plates 75. The upper end of the selector rod 80 is provided with a sprocket support bracket 81 having a sprocket 82 supported for rotation therein. The medial portion of a sprocket chain 83 extends beneath the sprocket 82 and its opposite ends are connected to the lower ends of the sprocket chains 72, fixed at their other ends to the respective sprocket wheels 66, 67.

In order to permit the user to perform infimetric or akinetic exercises on the present machine, a vertically disposed weight stop rod 90 is provided with upper and lower rubber bumpers and its upper end portion is fixed in one end of a horizontal swing bracket 91. The other end of the swing bracket 91 is supported for rotational movement on the upper end of the weight guide rod 77. A compression spring 92 surrounds the portion of the weight guide rod 77 extending above the swing bracket 91. During normal duosquat exercises the swing bracket 91 is moved outwardly to the position shown in FIGS. 1 and 8 so that the weight stop rod 90 will not interfere with the normal up and down movement of the selected stack of weight plates 75. The positioning and the operation of the weight stop rod 90, when used in the performance of infimetric or akinetic exercises, will be presently described.

OPERATION

When the compound exercising machine of the present invention is to be used for performing a normal duosquat exercise the user first moves the selector pin 78 into the proper horizontal bore for lifting the desired number of weight plates 75 to be used during the exercise. In the particular machine illustrated, the weight plates each are 25 pounds and there is a total of 20 plates so that it is possible, with the weight of the sprocket 82 and selector rod 80 for lifting 510 pounds. The amount of weight being lifted, as illustrated in the present drawings, is 135 pounds.

The counterweights 57 on the corresponding levers 16, 17 act to swing the lower ends of the lever 16, 17 forwardly to remove any slack in the chains 70, 72 and to normally maintain the levers 16, 17 in substantially the intermediate portions of their arcs of swinging movement, substantially in the position shown in FIG. 3. Thus, the levers 16, 17 are maintained in a position substantially even with the rearward ends of the side frames 12, 13 so that they do not interfere with the user entering and exiting from the machine. The user then positions himself on the body support pad 23, as illustrated in FIG. 1, with the shoulders in engagement with the shoulder pads 30, 31 and the belt 36 buckled around the lower body portion. Both legs are then fully extended so that the selected stock of weights 75 is lifted and the lower ends of the levers 16, 17 are moved forwardly until their portions adjacent the pivot shaft 18 engage the stop bar 15, as illustrated in FIGS. 1 and 2.

If the user is unable to move the levers 16, 17 forwardly against the stop bar 15 with the body support platform in a particular position the control handle 45 is raised by the user and the body support platform can then be moved forwardly or rearwardly until it is properly positioned so that the levers 16, 17 are forwardly against the stop bar 15 with the legs in substantially the straight position. When the control handle 45 is lowered, the rack teeth 29 will engage the rack 50 and fix the body support platform in the proper longitudinally adjusted position.

It is preferred that the legs be alternately exercised with one leg being moved from the extended to the retracted and back to the extended position while the other leg remains in substantially a straight or fully extended position. One exercise cycle of the right leg will be described, with particular reference to FIGS. 2–4, while the left leg, not shown, remains in the fully extended or substantially straight position.

As will be noted in FIGS. 1 and 2, the vertical position of the feet on the elongated foot pedals 20, 21 can be selected to engage the foot pedal at a low position, as shown in FIG. 1 to provide a longer moment arm between the pivot shaft 18 and the point at which the force is applied by the user. Also, the feet may be positioned adjacent the upper ends of the foot pedals 20, 21 to provide a shorter moment arm between the pivot shaft 18 and the point at which the force is applied by the user, as illustrated in FIGS. 2–4. The position at which the force is applied by the user is substantially in alignment with the ankle joint, indicated at A in FIGS. 2–4, the knee joint being illustrated at B, and the hip joint being illustrated at C.

As is known, the strength of the muscles varies at different positions of the leg. For example, when the leg is in substantially a straight line position, as shown in FIG. 2, substantially all of the force is directed in substantially a straight line and in alignment with the bones in the lower and upper leg. With the leg in this substantially straight position, the user could theoretically support an infinite weight, except for the fact that the bones and the material of which the machine is constructed (chains, etc.) will not support an infinite weight. As the leg approaches the straight or "lock-out" position, the muscles have the greatest amount of strength. Therefore, when the lever 16 is in the position shown in FIG. 2, the negative profile cam 62 will have a very small radius (moment arm) about the shaft 64.

Assuming, as a nonlimiting example, that the corresponding sprocket wheel 66 has a diameter of 12 inches, and therefore has a uniform radius (moment arm) of 6 inches about the shaft 64, the negative profile cam 62, with the lever 16 in the forward position as shown in FIG. 2, will have a radius of one and one-half inches. Thus, the length of the moment arm of the negative profile cam 62 will be one-fourth the length of the moment arm of the sprocket wheel 66 in this rotative position, shown in FIG. 2. In this position, a force of 540 pounds would have to be applied to the sprocket chain 70 by the user to maintain the level of the 135-pound weight. Thus, the amount of force applied by the user is greater than the amount of weight lifted and this is true because the longest radius (moment arm) of the negative profile cam 62 is shorter than the uniform radius (moment arm) of the corresponding sprocket wheel 66.

As the leg is moved rearwardly from the lock out position of FIG. 2 to the midrange of movement or "sticking point" illustrated in FIG. 3 the muscle strength of the user at first rapidly decreases and then more gradually decreases. Under these circumstances, the negative profile cam 62 must be designed so that the radius (moment arm) rapidly increases during the first few degrees of rotation and then gradually increases while the negative profile cam 62 is being rotated approximately 170 degrees, to the position shown in FIG. 3. At this position, the radius (moment arm) of the negative profile cam 62 has increased to 4 inches while the moment arm of the sprocket wheel 66 remains at the uniform 6 inches. When the negative profile cam 62 is in this position, the radius (moment arm) of the sprocket 66 is one and one-half times as long as the radius (moment arm) of the negative profile cam 62 so that only 202.5 pounds of force is required to be applied by the user to the chain 70 to maintain the 135-pound weight supported by the chain 72.

As the leg moves from the midposition shown in FIG. 3 to the squat position shown in FIG. 4, the strength of the muscles again increases but in a more gradual manner than the increase in muscle strength when the leg moves from the position shown in FIG. 2 to the position shown in FIG. 3. This more gradual increase in muscle strength is indicated by the gradual curve of the negative profile cam 62 with the radius gradually decreasing as it rotates from the position shown in FIG. 3 to the position shown in FIG. 4, a rotational movement of approximately 160 degrees. In moving the leg from the position shown in FIG. 3 to the position shown in FIG. 4, the amount of strength required to lower the weight 75 gradually decreases and when the squat position of the leg is reached (FIG. 4) the radius (moment arm) of the negative profile cam 62 has decreased to a length of approximately 2 inches so that the user must then apply 405 pounds of force to the chain 70 in order to gradually lower the 135-pound weight 75. This movement of the leg from the extended to the retracted position, while the weight 75 is being lowered is known as the negative work movement of the exercise cycle.

The variation of resistance is reversed when the leg is moved from the retracted position shown in FIG. 4 (squat) to the extended position shown in FIG. 2 to lift the weight 75 in performing a positive work movement of the exercise cycle. In the example given, the strength or force required by the user to lift the weight 75 when the leg is moved from the retracted position shown in FIG. 4 to sticking point the position shown in FIG. 3 will be gradually decreased from the 405 pounds applied in FIG. 4 to the 202.5 pounds applied in FIG. 3, while the negative profile cam 62 rotates through approximately 160 degrees. With movement of the leg from the sticking point position shown in FIG. 4 to the extended position shown in FIG. 2, the strength required by the user will at first gradually increase and then rapidly increase toward the end of the stroke, as indicated by the shape of the negative profile cam 62. The radius (moment arm) of the negative profile cam 62 is very short ($1\frac{1}{2}$ inches) at the end of the forward stroke of the lever 16. In this position of rotation, the force which must be applied by the user to the chain 70 is 540 pounds in order to maintain the 135-pound weight.

When exercising one leg on the machine, the lever 16 swings from the forward end to the rearward end of its arc of movement, as illustrated in FIGS. 2–4, while the chain 70 is wound onto the negative profile cam 62 and the chain 72 is unwound from the sprocket 66 as the weight 75 is being lowered in a negative work movement of the leg. The leg is then moved from the retracted position shown in FIG. 4 to the extended position shown in FIG. 2 while the lower end of the lever 16 is moved from the rearward end to the forward end of its arc of movement, while chain 70 is being unwound from the negative profile cam 62 and the chain 72 is being wound onto the sprocket wheel 66 as the weight 75 is being raised in a positive work movement by the leg.

It is preferred that the legs be alternately exercised and while one leg is being moved through the negative and positive work movements, the other leg will remain in the fully extended position. However, it is to be understood that one leg may be exercised for any predetermined number of repeated movements before exercising the other leg.

Because of the variation in the length of the radius (moment arm) of the negative profile cam 62, the proper amount variation of resistance to movement of the lever 16 is provided in all positions as the foot is being moved in substantially a straight line between the extended leg position (FIG. 2) and the retracted leg position (FIG. 3) and vice versa. By the use of the negative profile cam 62, there is literally no limit to the force the user can produce, except the limits imposed by the user's body and the limits imposed by the strength of the material of which the machine is constructed.

As illustrated in FIGS. 2–4, the length of the lever arm 16, below the pivot shaft 18 is greater than the length of the lever arm 16 above the pivot shaft 18. Thus, the feet of the user can be placed at the lower ends of the pedals, as illustrated in FIG. 1 so that the moment arm extending between the pressure point of the feet and the pivot shaft 18 is greater than the moment arm provided by the upper portion of the lever 16, that is from the pivot shaft 18 to the upper end of the lever 16. Thus, a mechanical advantage is provided to the user when the feet are positioned at the lower end of the pedal. On the other hand, the feet may be positioned adjacent the upper end of the pedal and the length of the moment arm between the pressure point of the foot and the pivot shaft 18, as indicated by dash-dot line 95 in FIGS. 2–4, is substantially the same length as the moment arm between the pivot shaft 18 and the upper end of the corresponding lever 16 so that no mechanical advantage is provided by the lever arm 16. In this case the same amount of force applied to the lower end of the lever by the user will be applied to the upper end of the lever and to the connector chain 70. Thus, with the feet positioned at the upper ends of the foot pedals 20, 21, the user must apply a greater force to lift and lower a given weight than would be the case if the user moved his feet to the lower ends of the foot pedals 20, 21. Also, the position of the feet on the foot pedals may be used to permit users with longer or shorter legs to use the machine with the body support pad 23 in the same adjusted position.

The machine of the present invention also provides the user with the benefits of the productive exercise derived from a squat exercise and yet eliminates the dangers normally associated with a squat exercise. When exercising with the present machine, the force applied by the user is always applied along a line which is substantially parallel with the main bone in the lower leg, as indicated by the dash-dot line 96 in FIGS. 2–4, and this longitudinal line of force is always at substantially right angles to the moment arm of the corresponding lever 16, indicated by the dash-dot line 95. This direction of force longitudinally of the bone in the lower leg is not the same as the force applied to the bones when performing a conventional squat exercise. In the conventional squat exercise, the user bends the knees and the vertical direction of the weight tends to force the buttocks toward the heels, in a direction transversely of the bone in the upper leg, indicated by the dash-dot line 97, and the bone in the lower leg at the lowermost end of the squat so that the calf muscle engages the back of the thigh and the normal pivot point at the knee joint is actually moved rearwardly several inches to the point where the calf muscle engages the back of the thigh and the forces applied transversely of the bones tend to pull the knee joint apart.

Figure 9:
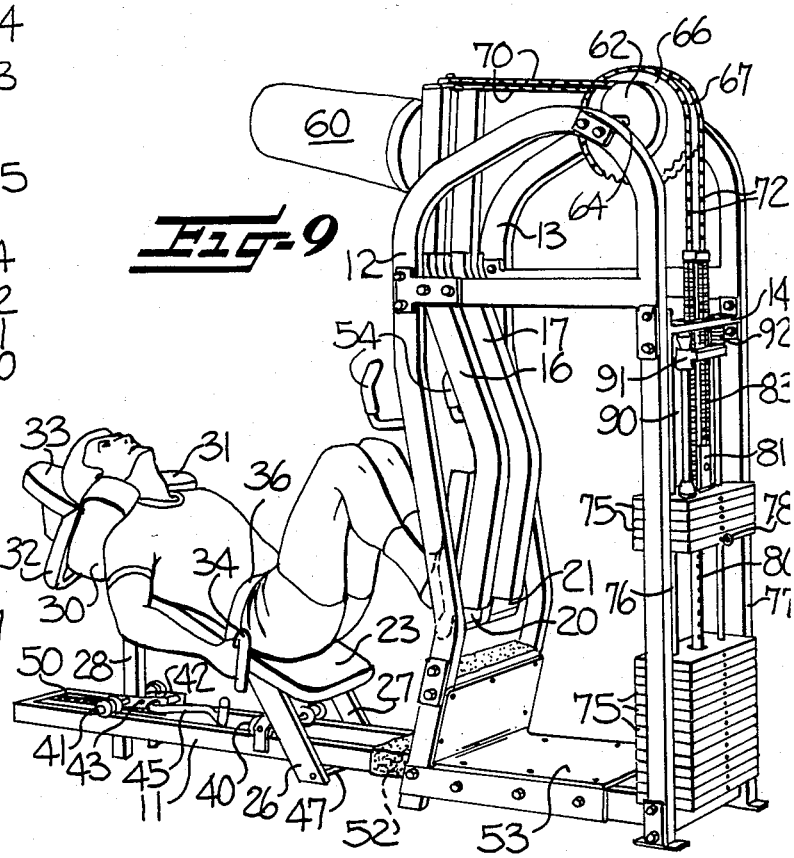
FIG. 9 is a view similar to FIG. 1 but showing the weight stack being lifted by both legs of the user and being restrained from further movement by a selectively positionable stop rod, used in the performance of infimetric or akinetic exercises.
Figure 10:
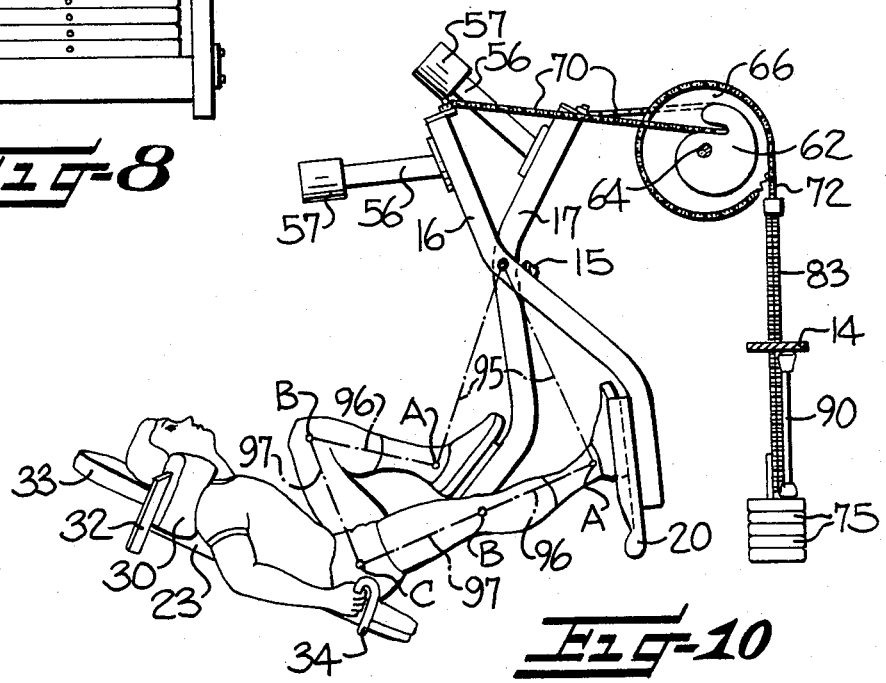
FIG. 10 is a somewhat schematic side elevational view of the machine shown in FIG. 9 and showing the machine being used for infimetric or akinetic exercise with one leg being in fully extended position and the other leg being in retracted position.

In FIGS. 9 and 10, the compound exercising machine of the present invention is illustrated as being used in akinetic exercise with the weight stop rod 90 being pivoted around into position to extend between the upper surface of the weights 75 and the lower surface of the crossframe 14. Both legs are then moved forwardly, as shown in FIG. 9, until the upper end of the weight stack is lifted against the lower end of the stop rod 90. The user then moves one leg forwardly applying positive work thereto while at the same time moving the other leg rearwardly in a negative work movement. The weights are maintained against the lower end of the stop rod 90 so that a predetermined amount of resistance is applied to the legs. Of course, the user can still supply the same amount of force, one leg against the other, and any time the amount of force applied is not sufficient, the weight stack will drop below the lower end of the stop rod 90. Infimetric exercise can also be performed on the present compound exercise machine and in this case, the pin 78 is removed so that all of the weight plates are disconnected and remain in the lowermost position. The legs are then alternately moved inwardly and outwardly in negative and positive work movements with the user applying positive and negative forces by resisting a greater or lesser amount with the bending limbs. To convert the exercise machine back to the regular compound squat exercise, the weight stop bar 90 is merely pivoted back to the outermost position shown in FIG. 1 so that it does not interfere with the normal lifting and lowering of the weight 75.

The compound exercising machine of the present invention provides the proper amount of variation of resistance to movement in all pivotal positions of two or more body joints when the distal end of the limb is moved in a substantially straight line between the extended and retracted positions and vice versa. The present machine also eliminates the potential danger of damaging the knee when performing a squat exercise because the varied resistance in the lower leg is applied in a direction longitudinally of the bone, rather than in a transverse direction, which is normally experienced in the performance of a squat exercise. The negative profile cam of the present machine operates differently than the operation of the positive profile cam of the type heretofore used in single-axis exercise machines and permits almost infinite force to be applied by the user. The negative profile cam also permits rapid variations of resistance in a manner which cannot be obtained by the use of a positive profile cam.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A machine for the compound exercising of the muscles associated with the limbs and for providing the proper variation of resistance to movement in all positions when the distal end of the limb is being moved in substantially a straight line between the extended and retracted positions and vice versa, said machine comprising (1) frame means supporting components of said machine, (2) a user-actuated lever pivotally supported on said frame means for swinging back and forth movement of one end thereof, (3) force transfer means supported on said user actuated lever and at a predetermined distance from the pivotal connection of said lever, said force transfer means being adapted to be engaged by the distal end portion of the limb to be exercised to move said one end of said lever back and forth in a predetermined arc of movement, one end of the arc of movement being reached when the limb is in substantially extended position and the other end of the arc of movement being reached when the limb is in substantially retracted position, (4) a negative profile cam supported for rotation on said frame and having a different radius at different degrees of rotation thereof to provide moment arms of different lengths as said negative profile cam is rotated, (5) first flexible connector means fixed at one end to a position on said negative profile cam and being connected at its other end to said lever at a position spaced from the pivotal support thereof, (6) weight means for offering resistance during an exercise, said weight means being adapted for vertical movement on said frame, (7) a wheel supported for rotation on said frame and having a uniform radius larger than any radius of said negative profile cam so that the amount of force applied by the user to said force transfer means to raise said weight means is greater than the amount of weight provided by said weight means, said wheel being fixed to rotate with said negative profile cam, and (8) second flexible connector means fixed at one end to a position on said wheel and being connected at its other end to said weight means, said second flexible connector means being wound onto said wheel to lift said weight means while said first flexible connector means is being unwound from said negative profile cam when said lever is being moved toward one end of said arc of movement, and said second flexible connector means being unwound from said wheel to lower said weight means while said first flexible connector means is being wound onto said negative profile cam when said lever is being moved toward the other end of said arc of movement whereby the proper variation of resistance to movement is provided in all positions when the limb is being moved in substantially a straight line between the extended and retracted positions and vice versa.

2. A machine according to claim 1 particularly adapted for use in exercising the legs of the user and wherein said user actuated lever extends in substantially a vertical position and is pivotally supported in an intermediate position with a portion thereof extending upwardly above the pivotal connection, wherein said other end of said first flexible connector means is fixed to said user actuated lever arm at a position above said pivotal connection, and wherein said force transfer means comprises an elongate foot pedal fixed to the lower end portion of said user actuated lever and against which the user places the foot so that the proper variation of resistance is provided when the foot is being moved in substantially a straight line between extended position with the leg substantially straight and retracted position with the leg bent to a squat position and vice versa.

3. A machine for the compound exercising of the muscles associated with the legs and for providing the proper variation of resistance to movement in all positions when the distal ends of the legs are being moved in substantially a straight line between the extended and retracted positions and vice versa, said machine comprising (1) frame means supporting components of said machine, (2) body support means on said frame means for supporting the upper torso of the user in a reclining position with the spine in substantially straight condition, (3) a pair of user actuated levers pivotally supported on said frame and in substantially vertical spaced-apart position for swinging back and forth movement of the lower ends thereof, (4) a foot pedal supported on the lower ends of each of said user actuated levers, said pedals being adapted to be engaged by the feet of the user for movement of said levers back and forth in predetermined arcs of movement, one end of the arc of movement being reached when the corresponding leg is in substantially extended position and the other end of the arc of movement being reached when the corresponding leg is in substantially retracted position, (5) a pair of negative profile cams supported for rotation of said frame and in adjacent spaced relationship, each of said negative profile cams having a different radius at different degrees of rotation thereof to provide moment arms of different lengths as said negative profile cam is rotated, (6) a pair of first flexible connector means, each being connected at one end to a position on the corresponding one of said negative profile cams and being connected at its other end to said corresponding lever at a position spaced from the pivotal support thereof, (7) a pair of wheels supported on said frame for rotation and in spaced apart relationship, each having a uniform radius and being fixed to rotate with said corresponding negative profile cams, (8) weight means offering resistance during an exercise, said weight means being supported for vertical movement on said frame, and (9) a pair of second flexible connector means, each being connected at one end to a position on the corresponding one of said wheels and being connected at its other end to said weight means, each of said second flexible connector means being wound onto said corresponding wheel to lift said weight means while said corresponding first flexible connector means is being unwound from said corresponding negative profile cam when said corresponding lever is being moved toward one end of said arc of movement, and said corresponding second flexible connector means being unwound from said corresponding wheel to lower said weight means while said corresponding first flexible connector means is being wound onto said corresponding negative profile cam when said corresponding lever is being moved toward the other end of said arc of movement, the longest radius of each of said negative profile cams being less than the length of the uniform radius of said corresponding wheel so that the amount of force applied by the user to said corresponding lever is greater than the amount of weight provided by said weight means, and the proper variation of resistance to movement is provided in all positions of said corresponding lever when the leg is being moved in substantially a straight line between the extended and retracted positions and vice versa.

4. A machine according to claim 3 wherein said body support means extends rearwardly from said foot pedals and includes a forward end spaced from said foot pedals, said body support means including a pair of shoulder pads supported adjacent the rear end portion thereof, and a headrest extending between said shoulder pads.

5. A machine according to claim 4 wherein said body support means includes a support pad inclined at an angle of approximately 30 degrees from the horizontal and extending upwardly and away from said foot pedals.

6. A machine according to claim 4 or 5 wherein said body support means is supported on said frame means for longitudinal adjustment toward and away from said foot pedals to permit said machine to accommodate users of different heights.

7. A machine according to claim 6 wherein said body support adjustment means comprises a body support frame, a rack carried by said frame means and extending longitudinally beneath said body support frame and away from said foot pedals, and means carried by said body support frame for selective engagement with said rack to permit longitudinal adjustment thereof and to support said body support frame in adjusted position.

8. A machine for the compound exercising of the muscles associated with the legs and for providing the proper variation of resistance to movement in all positions when the distal ends of the legs are being moved in substantially a straight line between the extended and retracted positions and vice versa, said machine comprising (1) frame means supporting components of said machine, (2) a pair of user actuated levers pivotally supported on said frame and in substantially vertical spaced-apart position for swinging back and forth movement of the lower ends thereof, (3) a foot pedal supported on the lower ends of each of said user actuated levers, said pedals being adapted to be engaged by the feet of the user for movement of said levers back and forth in predetermined arcs of movement, one end of the arc of movement being reached when the corresponding leg is in substantially extended position and the other end of the arc of movement being reached when the corresponding leg is in substantially retracted position, (4) body support means extending rearwardly from said foot pedals and including a pair of shoulder pads supported adjacent the rear end portion thereof, a headrest extending between said shoulder pads, and a support pad inclined at an angle of approximately 30 degrees from the horizontal and extending upwardly and away from said foot pedals, (5) body support adjustment means for supporting said body support for longitudinal adjustment on said frame means and for supporting the upper torso of users of different heights in a reclining position with the spine in substantially straight condition and comprising a body support frame, a rack carried by said frame means and extending longitudinally beneath said body support frame and away from said foot pedals, and means carried by said body support frame for selective engagement with said rack to permit longitudinal adjustment thereof and to support said body support frame in adjusted position, (6) said body support frame including a pair of forward legs, a forward pair of guide rollers supported on the lower portions of said forward legs, a single rear leg fixed on said support frame and having a lower end aligned with said rack, rack teeth on the lower end of said rear leg, a rear pair of guide rollers, and lever means interconnected between said rear leg and said rear guide rollers for permitting said rack teeth on the lower end of said rear leg to be lifted out of engagement with said rack to facilitate adjustment of said body frame means, (7) a pair of negative profile cams supported for rotation on said frame and in adjacent spaced relationship, each of said negative profile cams having a different radius at different degrees of rotation thereof to provide moment arms of different lengths as said negative profile cam is rotated, (8) a pair of first flexible connector means, each being connected at one end to a position on the corresponding one of said negative profile cams and being connected at its other end to said corresponding lever at a position spaced from the pivotal support thereof, (9) a pair of wheels supported on said frame for rotation and in spaced apart relationship, each having a uniform radius and being fixed to rotate with said corresponding negative profile cams,

(10) weight means supported for vertical movement on said frame, and

(11) a pair of second flexible connector means, each being connected at one end to a position on the corresponding one of said wheels and being connected at its other end to said weight means, each of said second flexible connector means being wound onto said corresponding wheel to lift said weight means while said corresponding first flexible connector means is being unwound from said corresponding negative profile cam when said corresponding lever is being moved toward one end of said arc of movement, and said corresponding second flexible connector means being unwound from said corresponding wheel to lower said weight means while said corresponding first flexible connector means is being wound onto said corresponding negative profile cam when said corresponding lever is being moved toward the other end of said arc of movement, the longest radius of each of said negative profile cams being less than the length of the uniform radius of said corresponding wheel so that the amount of force applied by the user to said corresponding lever is greater than the amount of weight provided by said weight means, and the proper variation of resistance to movement is provided in all positions of said corresponding lever when the leg is being moved in substantially a straight line between the extended and retracted positions and vice versa.

9. A machine according to claim 8 wherein said lever means interconnecting said rear guide rollers and said rear leg includes an operating handle extending outwardly for engagement by the user.

* * * * *